United States Patent [19]

Routti

[11] Patent Number: 4,976,423

[45] Date of Patent: Dec. 11, 1990

[54] ROWING DEVICE

[76] Inventor: Jorma Routti, Lutherinkatu 2 B, 18, SF-00100 Helsinki, Finland

[21] Appl. No.: 303,667

[22] PCT Filed: Jul. 22, 1987

[86] PCT No.: PCT/FI87/00098

§ 371 Date: Jan. 25, 1989

§ 102(e) Date: Jan. 25, 1989

[87] PCT Pub. No.: WO88/00905

PCT Pub. Date: Feb. 11, 1988

[30] Foreign Application Priority Data

Jul. 25, 1986 [FI] Finland ..... 863058

[51] Int. Cl.[5] ..... A63B 69/06

[52] U.S. Cl. ..... 272/72; 272/1 B

[58] Field of Search ..... 272/72, 1 B, 134, 93

[56] References Cited

U.S. PATENT DOCUMENTS

| | | | |
|---|---|---|---|
| 1,536,256 | 5/1925 | Calzetti | 272/72 |
| 2,278,591 | 4/1942 | Sak | 272/72 |
| 3,266,801 | 8/1966 | Johnson | 272/72 |
| 4,477,071 | 10/1984 | Brown et al. | 272/72 |
| 4,618,140 | 10/1986 | Brown | 272/72 |

FOREIGN PATENT DOCUMENTS

| | | | |
|---|---|---|---|
| 0032698 | 7/1981 | European Pat. Off. . | |
| 0146274 | 6/1985 | European Pat. Off. . | |
| 2938211 | 4/1981 | Fed. Rep. of Germany | 272/72 |
| 3016857 | 11/1981 | Fed. Rep. of Germany | 272/72 |
| 2214630 | 8/1974 | France | 272/72 |
| 369474 | 9/1974 | Sweden . | |

*Primary Examiner*—Stephen R. Crow

*Attorney, Agent, or Firm*—Young & Thompson

[57] ABSTRACT

Rowing device, especially a rowing device to be fastened on a wind surf board, comprising a framework (1), a fixed seat (7) fastened to the framework (1) and a foot support unit (2) movable in the framework (1) longitudinally with respect to the seat (7), as well as foot supports (6). The foot support unit is provided with detachable rowlock supports for oars. The rowing device can also be used as an independent rowing exerciser. This is accomplished with fastening members (4*a*, 14, 15) for a combination of a pump cylinder (10) and an oar lever (9*b*).

2 Claims, 1 Drawing Sheet

FIG. 1
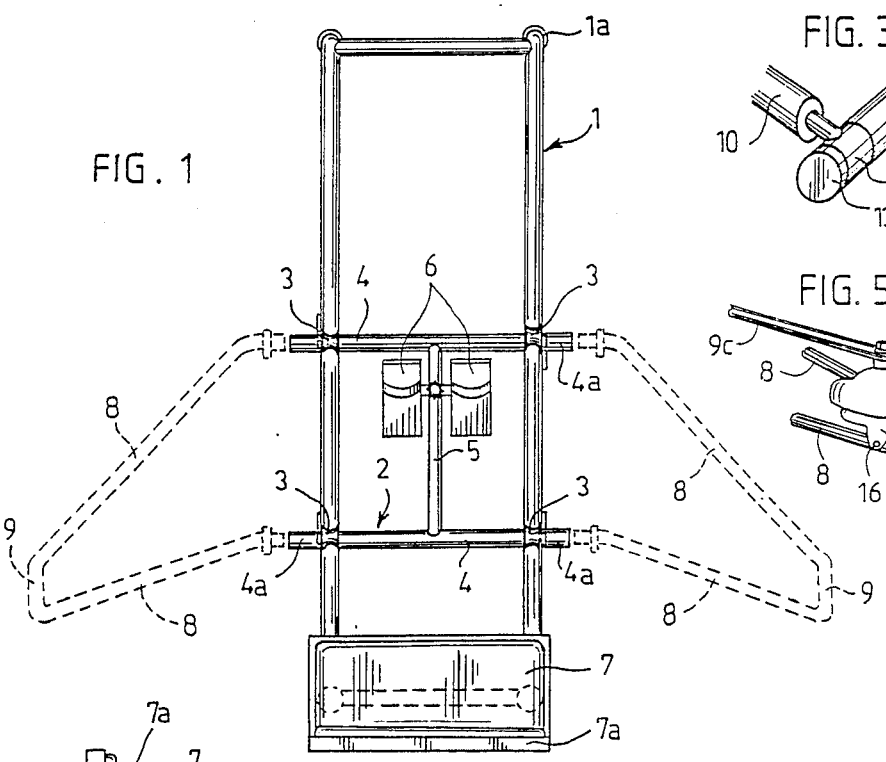
FIG. 3a
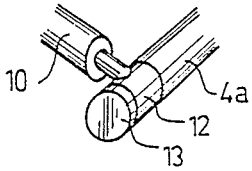
FIG. 5
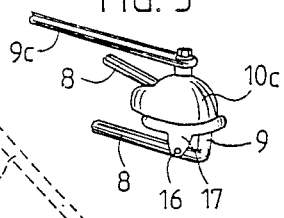
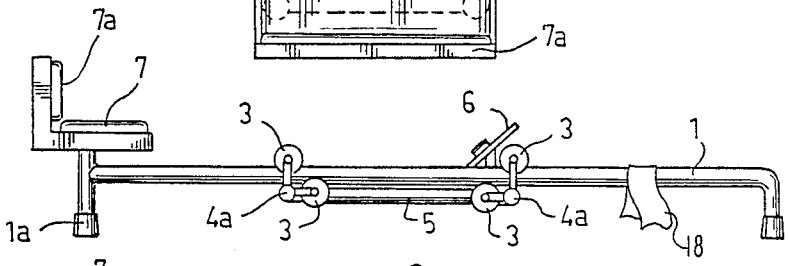
FIG. 2
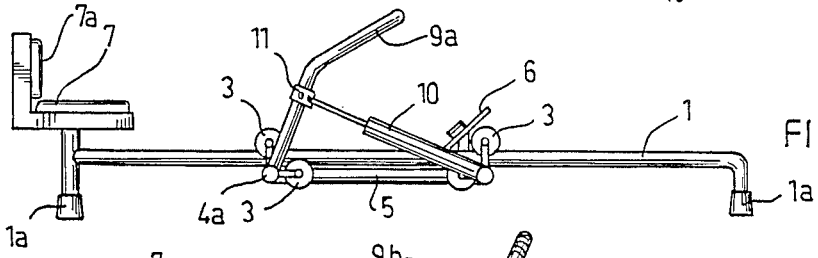
FIG. 3
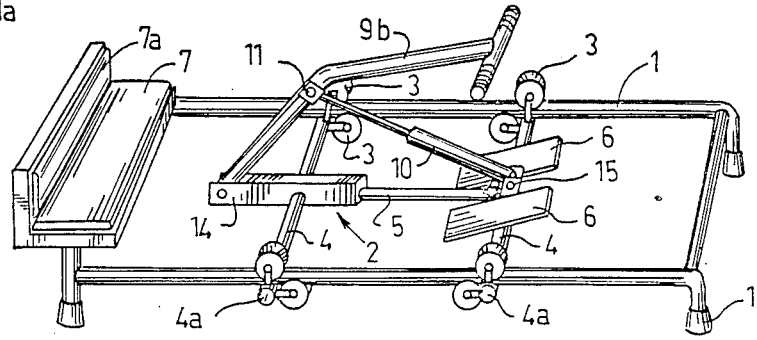
FIG. 4

ROWING DEVICE

BACKGROUND OF THE INVENTION

The invention relates to a rowing device, especially a rowing device to be fastened on a wind surf board, comprising a framework, a fixed seat fastened to the framework and a foot support unit movable in the framework longitudinally with respect to the seat, which foot support unit is provided with detachable rowlock supports.

Conventional racing rowing boats employ, in relation to the hull of the boat, a fixed foot support, fixed rowlock supports and a movable seat. The drawback of a construction like this is that owing to the movements of the rower, the boat must be made long and the centre of gravity of the boat changes continuously, making its running properties worse. The rower also unnecessarily consumes energy to surmount the inertia of the upper part of his body.

To solve these problems, a construction has been suggested where the seat is fixed and the foot support as well as the rowlock supports are movable with respect to the seat. A racing rowing boat like this is known e.g. from GB patent application No. GB A 2 099 773. From German Offenlegungsschrift No. DOS 3 016 857 again, it is known to fasten such a rowing device on a wind surf board or a surf board, whereby the wind surf board can simply be made to a "rowing boat", fitting excellently e.g. for exercise purposes.

The drawback of such an exerciser is, however, that it can only be used during periods when it is possible to row outside.

SUMMARY OF THE INVENTION

The object of the present invention is to provide a rowing device of the type described at the beginning, which is suitable to be used all the year round so that it can be used as an independent rowing exerciser and in summertime, it can be connected to e.g. a wind surf board, whereby it becomes a "rowing boat of racing model" as described above. This possibility to combine is reached in the way described herein.

By means of a combined rowing device and rowing exerciser of the invention, it is possible to make use of already existing wind surf boards, whereby it is easy to effect a "rowing boat" suitable for e.g. exercise, and by means of this device, it is, on the other hand, possible to practice rowing as a versatile form of exercise all the year round, which makes it unnecessary to a have a separate rowing exerciser.

BRIEF DESCRIPTION OF THE DRAWINGS

In the following, the invention is described in more detail with reference to the examples according to the enclosed drawings, where FIG. 1 shows the basic structure of a rowing device of the invention from above, FIG. 2 shows the basic structure of the rowing device from the side, FIG. 3 shows the rowing device of the invention changed into an independent rowing exerciser, FIG. 3*a* shows the fastening of the pump cylinder of the rowing exerciser according to FIG. 3 in more detail, FIG. 4 shows a perspective view of a second embodiment of the rowing exerciser, and FIG. 5 shows a perspective view of a third embodiment of the rowing exerciser.

DETAILED DISCUSSION

In all figures, the same reference numerals are used for the same parts. The basic structure of the rowing device shown in the FIGS. 1 and 2 comprises a framework 1, below which there are plastic or rubber feet 1*a* to be brought into contact with the base, which feet also can be of suction pad type to be fastened on a wind surf board. To the framework is fastened a foot support unit 2 moving along the framework by means of rollers 3. The foot support unit 2 is formed by two cross-tubes 4 and by one or two middle tubes 5 combining them. To the middle tube 5 are fastened foot supports 6, which are adjustable in the longitudinal direction and to which the rower fastens his feet e.g. by means of a strap. To each end of each cross-tube 4 are fastened two rollers 3 against the framework, by means of which rollers the foot support unit 2 slides along the framework 1. At one end of the framework, there is a fixed seat 7 with a back board 7*a* for the rower. The cross-tubes 4 of the foot support unit 2 are formed so that their ends 4*a* project outside the framework 1.

If it is desirable to use the rowing device as "a rowing boat of racing model" as described above, i.e. combined with e.g. a wind surf board, rowlock supports 8, shown by means of a broken line in FIG. 1, together with rowlocks 9 are fastened to the ends 4*a* of the cross-tubes 4 for rowing, which rowlock supports are bent to a suitable height relative to the framework. The figures do not show how the rowing device is fastened on the wind surf board. This fastening can be effected in many ways, e.g. by tightening the device by means of straps 18 to the board or by using the spar hole of the board for fastening. The rowing device can be fastened, besides to a wind surf board, also e.g. to a boat or a canoe with a sufficient seat opening, if only the rowlock supports 8 are formed so that the sides of the boat or the canoe do not stand in their way.

FIG. 3 shows how the rowing device of the invention can be changed into a rowing exerciser. Thereby, a pump cylinder 10 including an oar lever 9*a* is fastened to both sides of the foot support unit, which pump cylinder and oar lever are known per se from rowing exercisers. One end of the pump cylinder 10 is fastened to the oar lever 9*a* by means of a fastener 11, the location of which can be changed for an adjustment of the necessary tractive force. The lower end of the pump cylinder opposite to the oar lever 9*a* is fastened to the end 4*a* of one cross-tube 4 and the lower end of the oar lever 9*a* is fastened to the end 4*a* of the opposite cross-tube.

FIG. 3*a* shows an example of how the lower end of the pump cylinder 10 is fastened pivotally. At the end of the pump cylinder there is a socket 12, which is pushed on the tapered part of the end 4*a* of the cross-tube, whereafter a pivot 13 is screwed into counter-threads formed on the inner surface of the tapered part of the tube end, said pivot preventing the pump cylinder 10 from moving laterally, but allowing it, however, to turn around the tube. The pivot 13 can be provided with a handle to facilitate the screwing. The lower end of the oar lever 9*a* can be fastened in the same way. Instead of locking by means of a pivot, the oar levers and the pump cylinder as well as the rowlock supports 8 can be fastened even in such a manner that the socket or the end of the rowlock support is pushed around the end 4*a* of the equally thick tube and the oar lever and the pump cylinder are fastened pivotally and the rowlock supports are locked thereto by means of cotters or some kind of quick-locking devices.

FIG. 4 shows a perspective view of a second embodiment of the rowing exerciser, which is provided with only one pump cylinder 10 and one oar lever 9*b*. The lower end of the pump cylinder is now fastened pivotally to lugs 15 arranged on the cross-tube 4. The lower end of the oar lever can be fastened pivotally to the other cross-tube 4 of the foot support unit 2 by means of similar lugs 15 as the pump unit. For pivotal fastening, it is also possible to use detachable sockets attachable around the cross-tubes 4. If the length of the pump cylinder 10 or its path of movement presuppose a distance between the lower end of the pump cylinder and the lower end of the oar lever deviating from the length of the middle tube 5, it is possible to use an intermediate part 14 when fastening the lower end of the pump cylinder 10 or the lower end of the oar lever 9*b*, by means of which intermediate part the path of movement of the rower can be rendered more preferable. In FIG. 4, the lower end of the oar lever 9*b* is fastened pivotally to the intermediate part 14. A corresponding intermediate part can naturally also be used for fastening the lower ends of the oar levers 9*a* or of the pump cylinder of a rowing exerciser according to FIG. 3 provided with two pump cylinders.

FIG. 5 shows a perspective view of a third embodiment of the rowing exerciser. The fastening means for the combination of the pump cylinder and the oar lever are not situated directly in the foot support unit, but the rowlock supports 8 are attached to a basic structure according to FIGS. 1 and 2, to the ends of which rowlock supports the pump cylinder 10*c* is fastened by means of bolts 16 which penetrate the lugs 17 on the pump cylinder and the rowlock support 8. One end of the oar lever 9*c* is articulated on the top of the pump cylinder 10*c*. The pump cylinder according to FIG. 5, including the oar lever, is also known per se. To enable the oar lever 9*c* to move on more than one level, the pump cylinder 10*c* turns round the fastening axis defined by the bolts 16. Instead of being situated on the pump cylinder, the lugs 17 can also be situated either only on the rowlock supports 8 or alternatively on both the pump cylinder 10*c* and the rowlock supports 8.

Although the invention is described above with reference to the examples of the enclosed drawings, it is clear that the invention is not restricted to them, but it can be varied in many different ways within the scope of the inventive concept defined by the enclosed claims. For example, in order to simplify the construction, a sliding surface element placed between the cross-tube 4 and the framework 1 can substitute for the rollers 3 of the foot support unit 2 which are situated below the framework. In addition, the rowing device can be fitted into a smaller space during transportation or storage by detaching the foot support unit 2 and the rowlock supports 8 in one part from the framework 1 by making the upper rollers 3 supporting the foot support unit 2 detachable.

I claim:

1. A rowing device convertible from an outdoor rowing frame for use in conjunction with a surf board, to an independent indoor exercising device, comprising a framework forming a longitudinal track, a fixed seat for a user, said seat being fastened to one end of the framework, a foot support unit for the user's feet, said foot support unit comprising cross-tubes transverse to said longitudinal track and being moveable longitudinally along the track of the framework, detachable rowlock supports detachably fastened to the foot support unit when the device is used for outdoor rowing together with the surf board, means for interchangeably fastening to said device said rowlock supports and a combination of a pump cylinder and an oar lever, thereby enabling the device to be used as an independent indoor exercising device, said fastening means comprising locking elements disposed at ends of said cross-tubes for detachably locking said rowlock supports at the ends of said cross-tubes, said fastening means further comprising lugs disposed intermediate the length of said cross-tubes for pivotally connecting the lower end of a pump cylinder and the lower end of an oar lever, and means for attaching the framework to a surf board.

2. The rowing device according to claim 1, further comprising a combination of a pump cylinder and an oar lever, said combination being detachably fastened to said fastening means when the device is used as an independent indoor exercising device.

* * * * *